United States Patent [19]

Hathaway

[11] Patent Number: 4,475,267

[45] Date of Patent: Oct. 9, 1984

[54] SHOCK ABSORBING BRACKET FOR A FALLFRONT CABINET

[75] Inventor: Richard A. Hathaway, Saratoga, Calif.

[73] Assignee: Ampex Corporation, Redwood City, Calif.

[21] Appl. No.: 364,734

[22] Filed: Apr. 2, 1982

[51] Int. Cl.[3] ..... E05D 11/06; E05F 1/08

[52] U.S. Cl. ..... 16/288; 16/302; 16/307; 16/360; 16/361; 108/160; 248/240.2; 312/324; 312/325

[58] Field of Search ..... 16/282, 287, 288, 294, 16/302, 304, 307, 311, 360, 361, 365, 366, 370; 312/311, 313, 324, 325, DIG. 33; 108/160; 248/240.1, 240.2

[56] References Cited

U.S. PATENT DOCUMENTS

| | | | |
|---|---|---|---|
| 573,197 | 12/1896 | Bartlemes | 16/294 |
| 1,864,599 | 6/1932 | Linder . | |
| 2,013,418 | 9/1935 | Moore | 292/263 |
| 2,185,213 | 1/1940 | Claud-Mantle | 16/288 |
| 2,268,104 | 12/1941 | Bentley . | |
| 2,565,442 | 8/1951 | Tharp | 16/82 |
| 2,629,883 | 3/1953 | Nowell | 16/302 X |
| 2,645,810 | 7/1953 | Gala | 16/288 |
| 2,648,583 | 8/1953 | Teach | 312/136 |
| 2,674,511 | 4/1954 | Minor | 312/269 |
| 2,718,025 | 9/1955 | Stochl | 16/78 X |
| 2,910,336 | 10/1959 | Mustee | 16/49 X |
| 2,956,303 | 10/1960 | Fiedler | 16/288 |
| 3,183,927 | 5/1965 | Weese et al. | 16/288 X |
| 3,224,827 | 12/1965 | Foster et al. | 312/266 |

FOREIGN PATENT DOCUMENTS

| | | |
|---|---|---|
| 761794 | 1/1953 | Fed. Rep. of Germany . |
| 52339 | 11/1941 | Netherlands . |

*Primary Examiner*—Fred Andrew Silverberg

*Attorney, Agent, or Firm*—Charles M. Carman; Joel D. Talcott

[57] ABSTRACT

A shock absorbing fallfront bracket of the type having rigid hinged-together links diagonally supporting the fallfront panel in its open position and folding into the cabinet in closed position, and also including a third spring loaded link extending from the mutual hinge of the linked pair and to the cabinet to resiliently resist the full opening of the panel, and to fold, when closed, fully into the cabinet along with the supporting linked pair.

5 Claims, 3 Drawing Figures

SHOCK ABSORBING BRACKET FOR A FALLFRONT CABINET

BACKGROUND OF THE INVENTION

This invention relates to fallfront cabinets and particularly to such cabinets having shock absorbing means for the fallfront panel thereof.

In the fallfront cabinet and door-stop arts a number of different arrangements have been used for spring loading the folding or sliding supporting brackets for the fallfront panel or door, as shown, e.g., in U.S. Pat. Nos. 1,864,599; 2,013,418; 2,268,104; 2,565,442; 2,648,583; 2,674,511; 2,718,025; 2,910,336; 3,224,827; Netherlands No. 52339; and West Germany No. 761794. U.S. Pat. No. 2,718,025, for example, shows a flexible chain link between a door and its frame, the link being spring loaded at the midpoint by means of a tension spring running to the vicinity of the hinge portion of the door or frame.

This prior art device was designed for vertically mounted doors, and dangling of the flexible chain links and spring when the door is closed (FIG. 1) is of only slight disadvantage.

Such dangling of chain, however, would be intolerable in, e.g., a Sheraton secretaire such as the one illustrated on page 172 of "English Furniture and Decoration 1680 to 1800," G. M. Elwood, published by Julius Hoffman, Stuttgart MCMIX.

Less offensive but equally impractical would be the use of dangling chains in the cabinet of a modern magnetic tape transport, such as the one employing the present invention, which includes a fallfront panel for access to interiorally-mounted circuits.

Accordingly, it is an object of the present invention to provide shock-absorbing apparatus for a fallfront cabinet, which apparatus automatically conceals itself with the cabinet is closed.

SUMMARY OF THE INVENTION

A shock absorbing fallfront bracket of the type having rigid hinged-together links diagonally supporting the fallfront panel in its open position and folding into the cabinet in closed position, and also including a third spring loaded link extending from the mutual hinge of the linked pair and to the cabinet to resiliently resist the full opening of the panel, and to fold, when closed, fully into the cabinet along with the supporting linked pair.

DESCRIPTION OF THE PREFERRED EMBODIMENT

Figure 1:
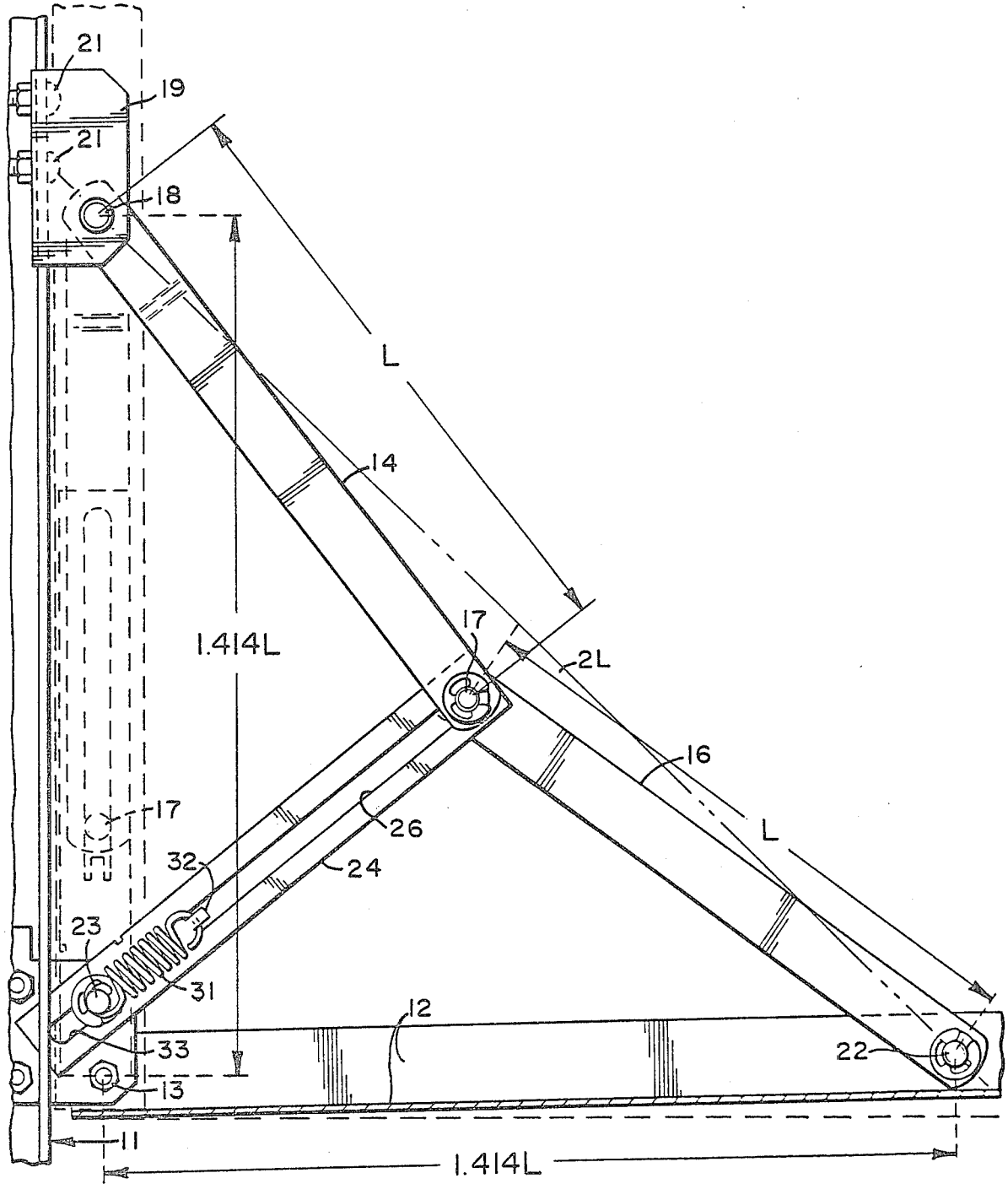
FIG. 1 is a fragmentary left side cross-section elevation taken on the plane of arrows 1—1 of FIG. 2 showing the bracket of the present invention in open position.
Figure 2:
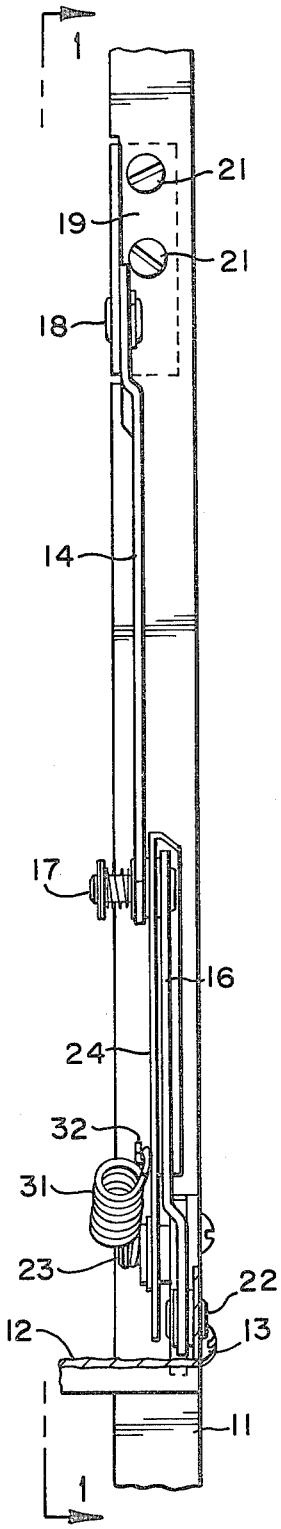
FIG. 2 is a fragmentary front elevation of the apparatus shown in FIG. 1.

Referring now to the drawing and particularly to FIGS. 1 and 2 thereof, there is shown the left side of a fallfront cabinet 11 including a fallfront panel 12 hinged to the cabinet at the lower edges as by hinges 13, and supported in the open position as by rigid links 14, 16 hinged together as by a spring loaded pin 17 and at adjacent ends the other end of upper link 14 being hinged to the cabinet as by a hinge pin 18 extending from a mounting bracket 19 that is affixed to the cabinet by bolts 21; and the lower link 16 being hinged to the panel 12 as by a hinge pin 22 extending from a side edge portion of the panel. In the present cabinet a pair of such link arrangements are employed, the other being applied to the right side of the cabinet.

Figure 3:
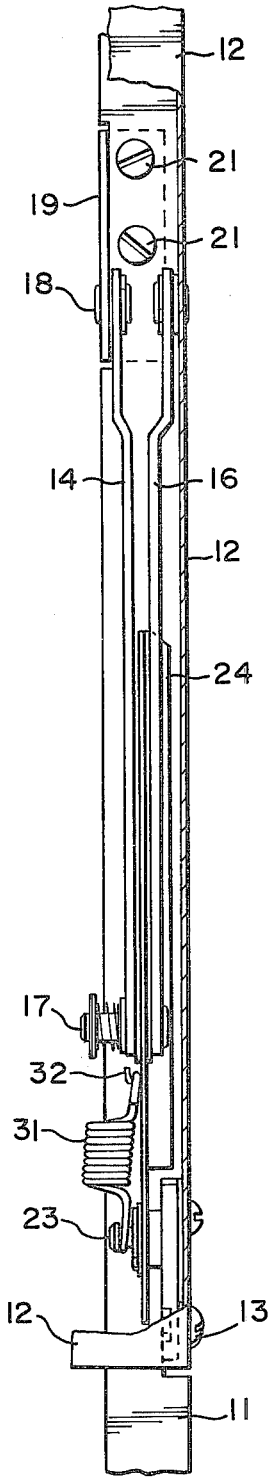
FIG. 3 is a fragmentary front elevation of the apparatus shown in FIGS. 1 and 2 in closed position.

It will be seen that in the above arrangement, the links when fully opened would describe the hypotenuse of a 45-degree right triangle, the hypotenuse being a dimension 2L, the dimension "L" being the length of each link 14, 16; and the hinge pins 18, 22 being spaced from the 90-degree apex by a dimension 1.414L. Consequently, there is a space below the closed position of the hinge pin 17 (as illustrated in phantom in FIG. 1 and in solid in FIG. 3) for the positioning of a third hinge pin 23 extending from the cabinet.

The third hinge pin 23 serves to pivot a third rigid link 24, which has a longitudinal slot 26 in which hinge pin 17 runs freely so as to define a sliding hinge connection to the link assembly 14, 16 at their mutual hinged portions. Thus, as the cabinet is closed, link 24 folds along with links 14, 16 to a concealed position illustrated in FIG. 3.

To absorb the final shock of opening panel 12, the link 24 is provided with a tension spring 31 looped at one end around an ear 32 at the lower end of slot 26, and at the other end around hinge pin 23; and the link is also formed with a second slot 33 in which hinge pin 23 slides. Thus, when the panel 12 is substantially but not fully opened (e.g. about 88.5 degrees), the spring 31 may be distorted to absorb the final shock of opening, and the panel 12 (after opening to some angle greater than 88.5 degrees but not greater than 90 degrees), returns to the static open position illustrated at about 88.5 degrees.

It has been found that the panel weight in the environment of the present invention is 14.0 lbs. It is estimated that the if the assembly is allowed to fall open without restraint and is then abruptly stopped with the panel horizontal, this weight would be increased by 10 G's and would represent 140 lbs. For a reasonable mounting position of the assembly as shown in FIG. 1 the actual increased weight would be 228 lbs. or 114 lbs. per side based on the system including two sets of links. The proper placement of link 24 would bring into engagement an energy absorbing spring 0.5 inch before links 14, 16 fall into a straight line to create a solid stop, and this 114 pound force can be held at equilibrium with only a 12.8 lb. spring force. If the spring were engaged only 0.125 inches from the stop, the equilibrium force would be reduced to only 3.2 lbs. However, to truly reduce G forces, the mechanism must stop over some reasonable distance. Due to space limitations and the need for a reasonable size energy absorbing spring with safe working stresses, the braking distance of 0.5 inch was selected, and accommodated by means of the slot 33.

What is claimed is:

1. A shock absorbing bracket apparatus for a cabinet and fallfront panel assembly, the panel being hinged to the cabinet along a bottom edge of the panel, comprising:

a bracket formed as a pair of rigid links hinged together at adjacent ends and to the cabinet and panel, respectively, at the other ends, so as to fold in redoubled fashion into said cabinet when the panel is closed and to unfold to a position of mutual rectilinear alignment to support the panel in horizontal position when opened;

a third rigid link and at one end thereof a first sliding hinge connection to at least one of said pair of links and at the other end of the third link a second hinge connection to the cabinet-panel assembly;

one of said hinge connections being a sliding resilient connection spring-loaded to resist the full opening of said pair of links and the rectilinear alignment thereof;

whereby the rigidity of said third link ensures the folding thereof along with said pair of links in redoubled fashion into said cabinet when the panel is closed.

2. Apparatus as recited in claim 1, wherein said third link is hinged by a common hinge connection to said pair of links at said adjacent ends thereof.

3. Apparatus as recited in claim 1, wherein said third link has a first longitudinal slot extending to said one end thereof, and said first hinge connection comprises a first hinge pin extending from one of the pair of links and running freely in said first longitudinal slot.

4. Apparatus as recited in claim 3, wherein said third link has a second longitudinal slot extending to said other end thereof, and said second hinge connection comprises a second hinge pin extending from said cabinet and running freely in said second slot.

5. Apparatus as recited in claim 4, wherein said sliding resilient hinge connection is comprised by said second hinge connection, and includes a helical tension spring attached to said second hinge pin at one end and at other end to said third link above said second slot, so as to urge said third link downwardly and inwardly engaging said second pin at the upper end of said second slot when said panel is nearly but not fully open.

* * * * *